US006209224B1

(12) United States Patent
Chuang

(10) Patent No.: US 6,209,224 B1
(45) Date of Patent: Apr. 3, 2001

(54) METHOD AND APPARATUS FOR MAKING A THROUGHDRIED TISSUE PRODUCT WITHOUT A THROUGHDRYING FABRIC

(75) Inventor: Strong C. Chuang, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/207,457

(22) Filed: Dec. 8, 1998

(51) Int. Cl.[7] ..... F26B 3/00; D06F 58/00

(52) U.S. Cl. ..... 34/448; 34/454

(58) Field of Search ..... 34/443, 444, 448, 34/452, 454, 115, 117, 119, 122, 124; 162/109, 111, 113, 117, 122

(56) References Cited

U.S. PATENT DOCUMENTS

| | | | | |
|---|---|---|---|---|
| 2,054,391 | | 9/1936 | Schmidt | 34/48 |
| 3,806,406 | | 4/1974 | Ely | 162/206 |
| 3,816,941 | | 6/1974 | Holik et al. | 34/116 |
| 3,821,068 | | 6/1974 | Shaw | 162/111 |
| 4,000,035 | | 12/1976 | Schiel et al. | 162/290 |
| 4,036,684 | | 7/1977 | Schmitt et al. | 162/290 |
| 4,087,319 | * | 5/1978 | Linkletter | 162/113 |
| 4,102,737 | | 7/1978 | Morton | 162/113 |
| 4,124,942 | | 11/1978 | Ohls et al. | 34/115 |
| 4,202,113 | | 5/1980 | Kankaanpaa | 34/23 |
| 4,247,990 | | 2/1981 | Ohls et al. | 34/23 |
| 4,477,983 | | 10/1984 | Andersson et al. | 34/114 |
| 4,768,294 | | 9/1988 | Weideburg | 34/116 |
| 5,397,437 | | 3/1995 | Ingemar | 162/203 |
| 5,425,852 | | 6/1995 | Joiner | 162/290 |
| 5,515,619 | * | 5/1996 | Kahl et al. | 34/114 |
| 5,557,863 | * | 9/1996 | Kokkala | 34/629 |
| 5,569,359 | | 10/1996 | Joiner | 162/206 |
| 5,667,636 | | 9/1997 | Engel et al. | 162/117 |
| 5,699,626 | * | 12/1997 | Chuang et al. | 34/453 |
| 5,701,682 | | 12/1997 | Chuang et al. | 34/115 |
| 5,861,082 | * | 1/1999 | Ampulski et al. | 162/117 |
| 5,897,745 | * | 4/1999 | Ampulski et al. | 162/109 |
| 6,004,429 | | 12/1999 | Schiel . | |
| 6,033,523 | * | 3/2000 | Dwiggins et al. | 162/111 |

FOREIGN PATENT DOCUMENTS

| | | |
|---|---|---|
| 2721146 A1 | 11/1978 | (DE) . |
| 0 051 055 A1 | 5/1982 | (EP) . |
| 36294 | 2/1906 | (FR) . |

* cited by examiner

*Primary Examiner*—Stephen Gravini
(74) *Attorney, Agent, or Firm*—Gregory E. Croft

(57) ABSTRACT

A method for making throughdried tissue products includes a throughdryer which functions without a throughdrying fabric. The tissue web is formed in a conventional manner and dewatered to a high consistency prior to being transferred to the surface of the throughdryer. The inside of the throughdryer is operated with a vacuum while a hot air hood serves to blow hot air through the web into the dryer. In one embodiment, the surface of the throughdrying drum is provided with circumferential ridges to impart bulk and cross-machine directional stretch to the resulting tissue. A doctor blade having ridges which intermesh with the circumferential ridges on the throughdryer surface can be used to skim the dried sheet from the dryer surface.

8 Claims, 2 Drawing Sheets

METHOD AND APPARATUS FOR MAKING A THROUGHDRIED TISSUE PRODUCT WITHOUT A THROUGHDRYING FABRIC

BACKGROUND OF THE INVENTION

In the manufacture of tissue products, such as facial tissue, bath tissue, paper towels and the like, the use of a throughdrying process is well known. In general, the throughdrying process involves passing hot air through a dewatered tissue web while the web is supported by a throughdrying fabric. More specifically, the fabric-supported web is dried while it is maintained in contact with a rotating throughdrying drum, which supplies the hot drying air. Depending upon the particular process, the dried web can be subsequently creped or left uncreped.

However, the current throughdrying methods are dependent upon throughdrying fabrics to provide the desired texture and structure to the resulting tissue product. The designs of such fabrics are limited by the inherent nature of the weaving process and the properties of the filaments used to weave the fabrics. A particular problem associated with many filament materials is their inability to withstand high temperatures. Of course, as efforts continue to increase the productivity of throughdrying tissue making machines, there is an incentive to be able to increase dryer temperatures and drying energy efficiency and shorten drying times. However, the throughdrying fabric is a limiting factor due to several reasons such as temperature degradation, loss of latent heat in each revolution of the dryer, etc.

Therefore there is a need for a method of improving the drying efficiency of throughdrying tissue machines.

SUMMARY OF THE INVENTION

It has now been discovered that the throughdrying fabric can be eliminated from the tissue machine by properly designing the throughdryer. This not only eliminates the costs of purchasing throughdrying fabrics and the down time costs associated with fabric changes, but the thermal efficiency of the drying process can also be improved.

Hence, in one aspect the invention resides in a method of making a throughdried tissue sheet comprising:(a) forming a tissue web; (b) dewatering the tissue web; (c) transferring the dewatered web from a supporting fabric to the surface of a throughdrying drum having a plurality of holes through which hot air passes to dry the web; (d) drying the web while on the surface of the throughdrying drum; and (e) removing the dried web from the surface of the throughdrying drum. Transfer of the web onto the surface of the throughdrying drum can be assisted by a blow box which blows compressed air through the supporting fabric towards the surface of the throughdrying drum. In addition, the transfer can be further assisted by the presence of a vacuum box within the throughdrying drum at the point of transfer. Removal of the dried web from the surface of the throughdrying drum can be assisted by the presence of a blow box within the throughdrying drum which blows air outwardly toward the dried web at the point of removal. Alternatively or in addition, a doctor blade can be used to skim the dried web from the surface of the throughdrying drum. In some cases, if the strength of the web is adequate, the dried web can be simply peeled off.

In another aspect the invention resides in a method of making a throughdried tissue sheet comprising:(a) forming a tissue web; (b) dewatering the tissue web; (c) transferring the dewatered web to the surface of a throughdrying drum without being supported by a throughdrying fabric, said surface of the throughdrying drum having a plurality of circumferential ridges; (d) drying the web while on the surface of the throughdrying drum; and (e) removing the dried web from the surface of the throughdrying drum. In this embodiment, the presence of the circumferential ridges impart significant bulk, cross-machine directional stretch and flexibility to the resulting dried web.

In another aspect, the invention resides in a throughdrying apparatus for drying a web, said apparatus comprising a perforated throughdrying drum having a plurality of circumferential ridges, a hot air hood for supplying hot air to the surface of the throughdrying drum, a vacuum zone within the throughdrying drum for drawing hot air from the hot air hood inwardly through the surface of the throughdrying drum to dry the web, and means for removing the dried web from the surface of the throughdrying drum. The means for removing the dried web from the surface of the throughdrying drum can include a ribbed doctor blade which is positioned against the surface of the throughdrying drum which skims the web from the surface and/or a blow box within the throughdrying drum which utilizes pressurized air to blow the web off of the surface of the throughdrying drum.

As used herein, a dried "tissue" web is a low density sheet of papermaking fibers suitable for use as facial tissue, bath tissue or paper towels, as distinguished from other more dense grades of paper such as writing papers.

DETAILED DESCRIPTION OF THE DRAWINGS

Figure 1:
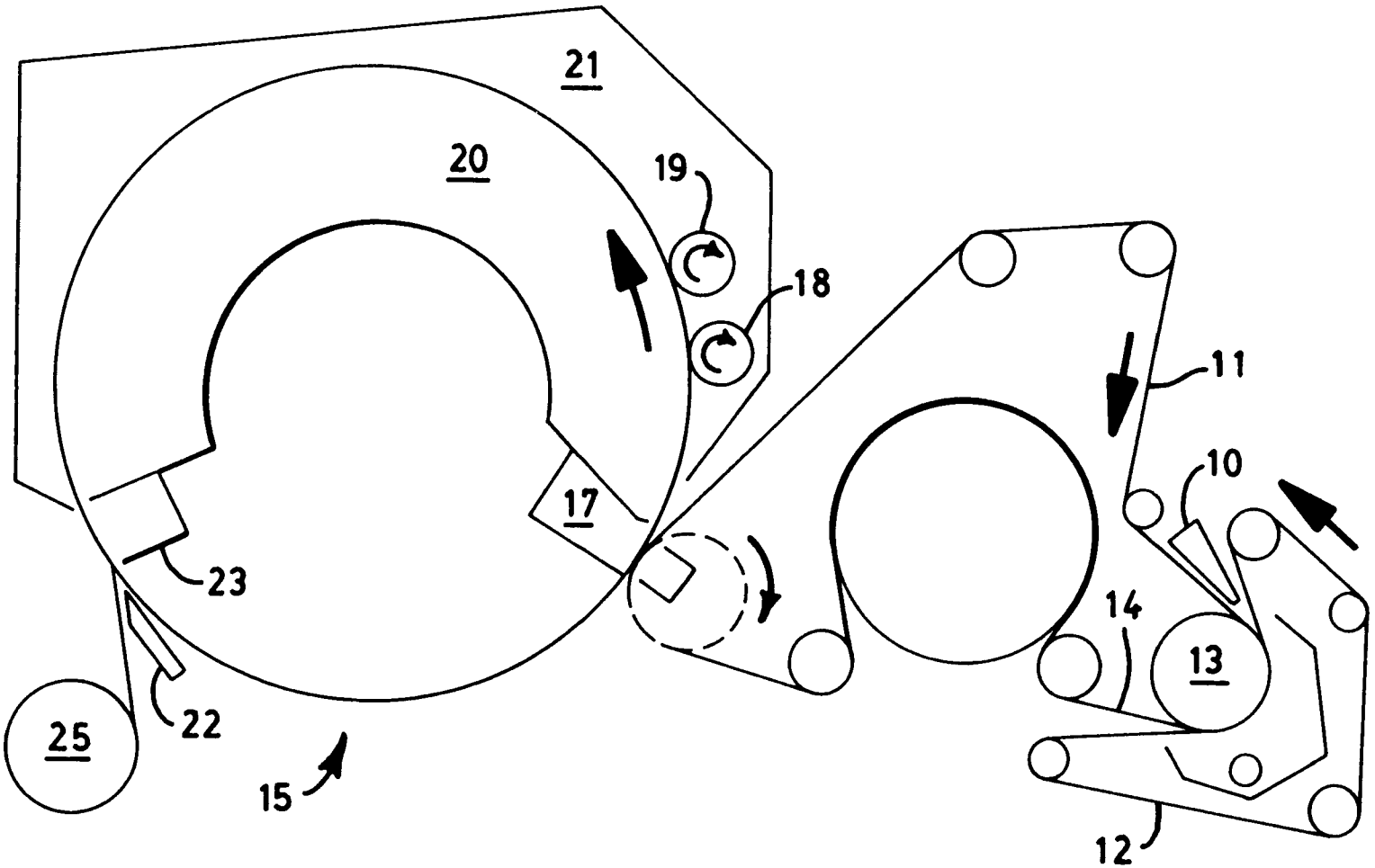
FIG. 1 is a schematic view of a method of this invention, illustrating the operation of the fabricless throughdrying drum.

Referring to FIG. 1, the invention will be described in greater detail. Shown is a papermaking headbox 10 which deposits an aqueous suspension of papermaking fibers between an inner forming fabric 11 and an outer forming fabric 12 as the fabrics traverse an arcuate path defined by the surface of the forming roll 13. The newly-formed web 14 is retained by the inner forming fabric and passed over an optional capillary dewatering roll for the purpose of non-compressively removing free water from the web. A suitable capillary dewatering roll is described in U.S. Pat. No. 5,701,682 entitled "Capillary Dewatering Method and Apparatus" issued Dec. 30, 1997 to Chuang et al., which is hereby incorporated by reference. Thereafter, the web is transferred to the surface of the throughdrying drum 15 with the aid of an optional blow box 16 in combination with an internal vacuum box 17. Optional press rolls 18 and 19 selectively densify and strengthen portions of the web in order to decouple the resulting tissue's strength from the overall high bulk and low density. The inside of the throughdrying drum contains a vacuum zone 20 in order to draw hot air from the hot air hood 21 through the web and into the inside of the throughdrying drum. As the dried web reaches the end of its arc, the web is removed from the surface of the drying drum, preferably either by skimming the web off of the surface using a ribbed doctor blade 22 and/or by blowing it off the surface using an optional blow box 23 and then wound into a parent roll 25 for further processing (converting into facial tissue, bath tissue, paper towels, etc.) in a normal manner. To the extent there are any residual fibers remaining on the surface of the throughdrying drum after the throughdrying drum rotates past the doctor blade, those fibers can be burned off of the surface of the throughdrying drum using a suitable burner in which the flame is directed at the surface. If a burner is used, the throughdryer drum needs to be made of a metal that can withstand the high temperatures resulting from direct fire. Those skilled in the art of throughdryers will be able to select appropriate metal compositions for such service. Advantageously, the residual heat on the surface of the throughdrying drum resulting from the burner is not wasted and can be utilized for the subsequent conductive drying of the wet paper.

Those skilled in the art will appreciate that many variations can be made to this process without departing from the scope of this invention. For example, other forming configurations can be substituted for the twin wire former illustrated, including crescent formers, Fourdrinier formers, suction breast roll formers, etc. Also, the newly-formed web can be transferred to an intermediate transfer fabric, with or without a rush transfer, prior to being transferred to the throughdryer. However, it can be particularly advantageous to rush transfer the web from the forming fabric to the transfer fabric, wherein the transfer fabric is traveling at a speed of from about 5 to about 75 percent slower than the forming fabric. An example of such a rush transfer step is described in U.S. Pat. No. 5,667,636 issued Sep. 16, 1997 to Engel et al. entitled "Method For Making Smooth Uncreped Throughdried Sheets", which is hereby incorporated by reference.

Figure 2:
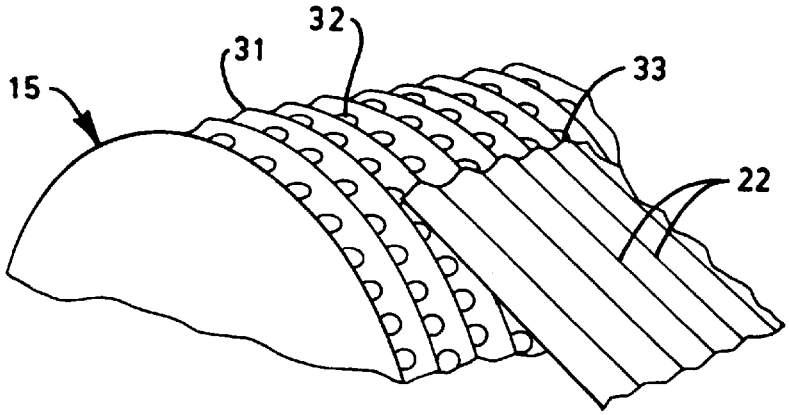
FIG. 2 is a perspective view of a representative portion of the surface of a throughdrying drum in accordance with this invention, illustrating the circumferential ridges on the surface of the throughdryer and an intermeshing ribbed doctor blade.

FIG. 2 is a perspective view of a representative portion of the surface of the throughdrying drum, shown interacting with an optional mating ribbed doctor blade designed to skim off the throughdried web from the surface of the throughdryer. More particularly, the surface of the throughdrying drum 15 is provided with a series of circumferential ridges 31 which provide a 3-dimensional contour and high bulk to the dried web. The ridges can be continuous or discontinuous in the circumferential direction (machine direction). In between the circumferential ridges are a plurality of holes 32 through which the hot drier air flows to dry the web. The ribbed doctor blade 22 also has its own series of ridges 33 which mesh with the ridges of the throughdryer surface to enable the ribbed doctor blade to scrape or skim the web off of the surface of the throughdryer. The leading edge of the doctor blade is tapered sufficiently to minimize any "creping" action in which the web would be buckled and the interfiber bonding substantially reduced.

Figure 3:
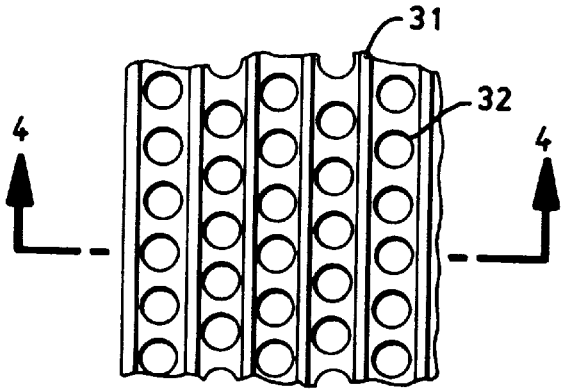
FIG. 3 is a plan view of a representative portion of the throughdryer surface, illustrating the arrangement of the vacuum holes and the circumferential ridges.

FIG. 3 is a plan view of a representative portion of the surface of the throughdryer surface, more clearly illustrating the plurality of holes 32 in between the ridges 31. The open area of the holes can vary depending upon the specific process conditions, but in general can be from about 15 to about 40 percent, more specifically from about 20 to about 35 percent.

Figure 4:
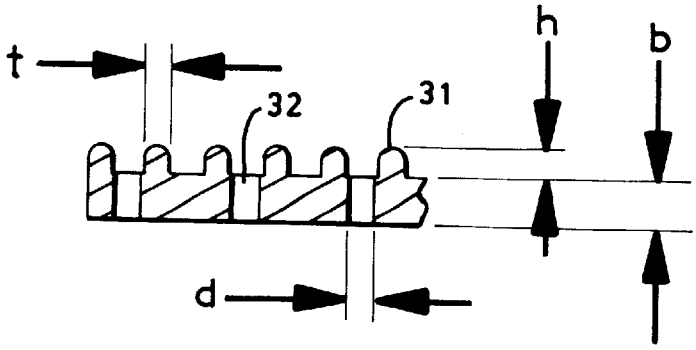
FIG. 4 is a cross-sectional view of the surface of the throughdryer drum, further illustrating the spacial relationship of the circumferential ridges and the holes.

FIG. 4 is a cross-sectional view of the surface of the throughdryer drum taken along line 4—4 of FIG. 3, more specifically showing the relative sizes of the holes and circumferential ridges. The height of the circumferential ridges is designated as "h", which can be from about 0.7 to about 2 millimeters. The width or thickness of the circumferential ridges is designated as "t", which can be from about 0.7 to about 1.5 millimeters. The spacing between the bases of the circumferential ridges is designated as "d", which can be from about 1.5 to about 3 millimeters. The depth of the holes through the surface wall of the throughdryer is designated as "b", which can be from about 2 to about 10 millimeters.

It will be appreciated that the foregoing description of the drawing, given for purposes of illustration, shall not be construed as limiting the scope of this invention, which is defined by the following claims and all equivalents thereto.

What is claimed is:

1. A method for making a tissue sheet comprising:

(a) forming a tissue web;

(b) dewatering the tissue web;

(c) transferring the dewatered web to the surface of a throughdrying drum without being supported by a throughdrying fabric, said surface of the throughdrying drum having a plurality of circumferential ridges;

(d) drying the web while on the surface of the throughdrying drum; and (e) removing the dried web from the surface of the throughdrying drum.

2. The method of claim 1 wherein the dewatered web of step (b) is supported by a first fabric and rush transferred to a second fabric traveling at a speed of from about 5 to about 75 percent slower than the first fabric.

3. The method of claim 1 wherein the dried web is removed from the surface of the throughdrying drum with a doctor blade having a plurality of ridges which intermesh with the circumferential ridges on the surface of the throughdryer surface.

4. The method of claim 1 wherein the dewatered web is transferred to the surface of the throughdrying drum with the aid of a blow box which urges the web against the surface of the throughdrying drum.

5. The method of claim 1 wherein the dried web is removed from the surface of the throughdrying drum with the aid of a blow box within the throughdryer which blows air outwardly through holes in the throughdrying drum surface.

6. The method of claim 1 wherein after the dewatered web is transferred to the surface of the throughdrying drum, the web is pressed between the surface of the throughdrying drum and one or more press rolls.

7. The method of claim 1 wherein any fibers adhering to the surface of the throughdrying drum after the web is removed are burned off by direct fire.

8. A method of making a throughdried tissue sheet comprising: (a) forming a tissue web; (b) dewatering the tissue web; (c) transferring the dewatered web from a supporting fabric to the surface of a throughdrying drum having a plurality of holes through which hot air passes to dry the web; (d) drying the web while on the surface of the throughdrying drum; and (e) removing the dried web from the surface of the throughdrying drum.

* * * * *